US010154714B2

(12) United States Patent
Wang

(10) Patent No.: US 10,154,714 B2
(45) Date of Patent: Dec. 18, 2018

(54) WATERPROOF CONTAINER HAVING A LOCK UNIT

(71) Applicant: Hudson Wang, Kaohsiung (TW)

(72) Inventor: Hudson Wang, Kaohsiung (TW)

( * ) Notice: Subject to any disclaimer, the term of this patent is extended or adjusted under 35 U.S.C. 154(b) by 198 days.

(21) Appl. No.: 15/256,773

(22) Filed: Sep. 6, 2016

(65) Prior Publication Data

US 2017/0071304 A1 Mar. 16, 2017

(30) Foreign Application Priority Data

Sep. 16, 2015 (CN) ..... 2015 1 0586779

(51) Int. Cl.

| | |
|---|---|
| ***A45C 13/00*** | (2006.01) |
| ***A45C 13/30*** | (2006.01) |
| ***B65D 81/38*** | (2006.01) |
| ***A45C 13/10*** | (2006.01) |
| ***A45C 13/18*** | (2006.01) |

(52) U.S. Cl.

CPC ..... *A45C 13/008* (2013.01); *A45C 13/103* (2013.01); *A45C 13/185* (2013.01); *A45C 13/30* (2013.01); *B65D 81/3897* (2013.01)

(58) Field of Classification Search

CPC ... A45C 13/008; A45C 13/103; A45C 13/185; A45C 13/30; B65D 81/3897

See application file for complete search history.

(56) References Cited

U.S. PATENT DOCUMENTS

| | | | | |
|---|---|---|---|---|
| 1,354,581 | A * | 10/1920 | Sheppard | B65D 29/00 383/86.2 |
| 5,297,870 | A * | 3/1994 | Weldon | A45C 13/008 383/59 |
| 5,413,199 | A * | 5/1995 | Clement | A45C 3/00 150/111 |
| 5,660,476 | A * | 8/1997 | DeCoster | A45C 11/20 190/108 |
| 6,206,567 | B1 * | 3/2001 | Cyr | A45C 3/00 190/903 |
| 6,286,462 | B1 * | 9/2001 | Burns | A01K 1/0254 119/497 |
| 2013/0341338 | A1 * | 12/2013 | Mitchell | A45C 11/20 220/592.2 |
| 2015/0225164 | A1 * | 8/2015 | Seiders | B65D 81/3858 220/592.25 |

* cited by examiner

*Primary Examiner* — Tri Mai

(74) *Attorney, Agent, or Firm* — McNees Wallace & Nurick LLC

(57) ABSTRACT

A waterproof container includes a bag unit, a seat unit, a cover unit and a lock unit. The seat unit is disposed on the bag unit and defines an opening. The cover unit includes a cover, and two zippers dividing the cover into a fixed portion and a flip portion. The lock unit includes a first lock seat disposed on the fixed portion, a second lock seat disposed on the flip portion, and a locking mechanism operable between a locking state, where the locking mechanism engages the first and second lock seats so as to prevent the flip portion from being flipped open, and a releasing state, where the locking mechanism does not engage the first and second lock seats so as to allow the flip portion to be flipped open when the zippers are unzipped.

19 Claims, 12 Drawing Sheets

WATERPROOF CONTAINER HAVING A LOCK UNIT

CROSS-REFERENCE TO RELATED APPLICATION

This application claims priority of Chinese Patent Application No. 201510586779.4, filed on Sep. 16, 2015.

FIELD

The disclosure relates to a waterproof container, more particularly to a waterproof container that provides thermal insulation and that has a lock unit.

BACKGROUND

Referring to FIG. 1, a conventional waterproof container 1 includes an inner foam layer 11, an outer bag 12 surrounding the inner foam layer 11, a cover 13 connected to a top end of the outer bag 12 and covering the outer bag 12, a foam pad 14 enclosed in the cover 13, and a zipper 15 interconnecting the outer bag 12 and the cover 13. The inner foam layer 11 and the foam pad 14 provide thermal insulation and prevent water from entering or exiting the waterproof container 1. However, since the inner foam layer 11 and the foam pad 14 are not fixedly connected, and since the inner foam layer 11, the outer bag 12, the cover 13 and the foam pad 14 are all made of soft and pliable materials, the conventional waterproof container 1 is susceptible to deform when an external force is exerted thereon, and a gap may be formed between the outer bag 12 and the cover 13. As a result, entry of water into the conventional waterproof container 1, and entry of heat into or dissipation of heat out of the conventional waterproof container 1 may occur through the gap or when the zipper 15 is unzipped, thereby adversely affecting the thermal insulation and waterproof properties of the conventional waterproof container 1. Moreover, since the zipper 15 surrounds the top end of the outer bag 12 for interconnecting the outer bag 12 and the cover 13, the zipper 15 may get stuck at corners of the outer bag 12 during a zipping or unzipping process, thereby resulting in inconvenience of users when using the conventional waterproof container 1. In addition, the zipper 15 may partially break off after a number of zipping and unzipping actions.

SUMMARY

Therefore, an object of the disclosure is to provide a waterproof container that can alleviate at least one of the aforesaid drawbacks of the prior art.

According to the disclosure, the waterproof container includes a bag unit, a seat unit, a cover unit and a lock unit.

The bag unit defines an accommodating space. The seat unit is disposed on a top end of the bag unit and defines an opening that is in spatial communication with the accommodating space. The cover unit includes a cover that removably and sealingly covers the opening of the seat unit, and two spaced-apart zippers that are disposed on the cover and that divide the cover into a fixed portion and a flip portion. The fixed portion is connected fixedly to the seat unit. The flip portion corresponds in position to the opening. The cover is operable between a flipped state, where the zippers are unzipped and the flip portion is flipped open for exposing the opening, and a non-flipped state, where the zippers are zipped for covering the opening with the flip portion. The lock unit is mounted to the cover unit, and includes a first lock seat that is disposed on one of the fixed portion and the flip portion, a second lock seat that is disposed on the other one of the fixed portion and the flip portion, and a locking mechanism that is operable between a locking state, where the locking mechanism engages the first and second lock seats so as to prevent the flip portion of the cover from being flipped open when the zippers are unzipped, and a releasing state, where the locking mechanism does not engage the first and second lock seats so as to allow the flip portion to be flipped open when the zippers are unzipped.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
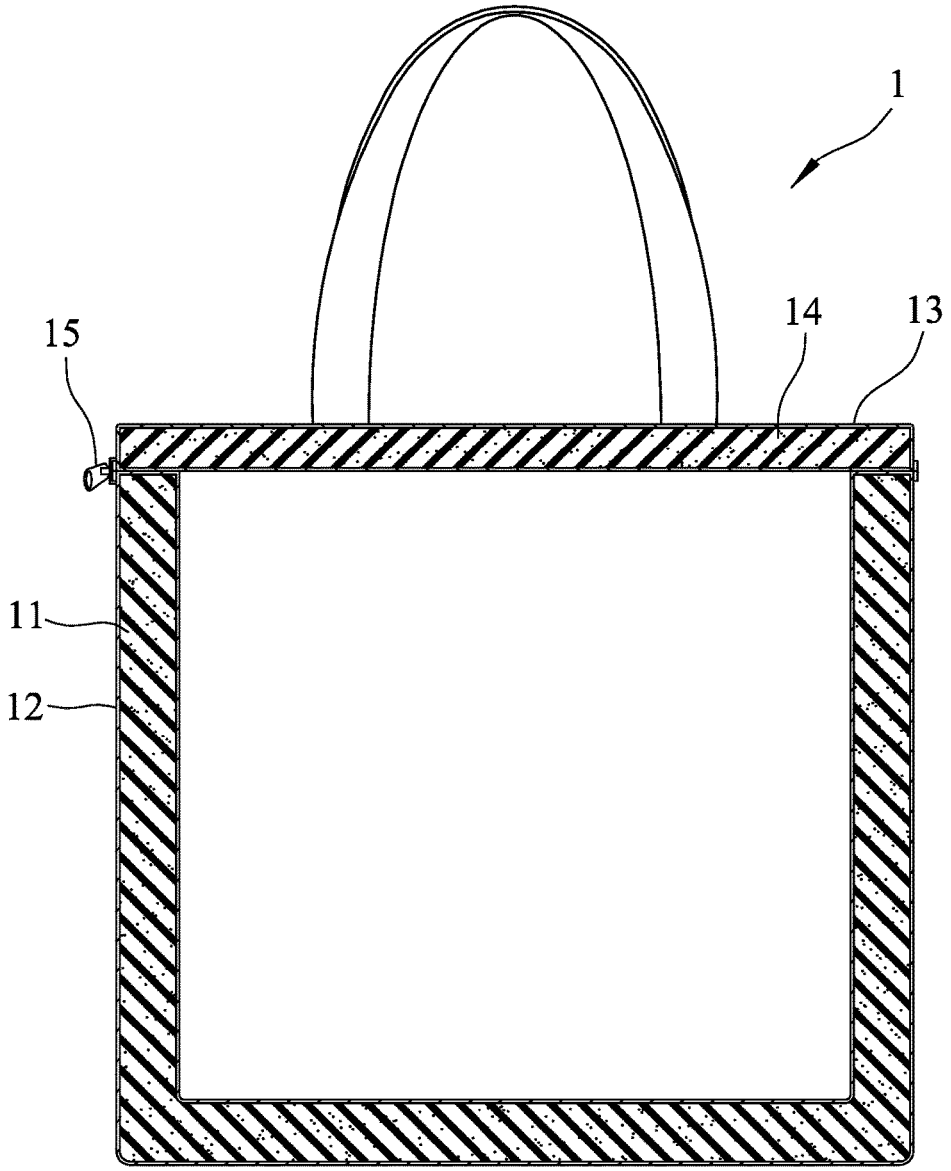
FIG.1 PRIOR ART
FIG. 1 is a sectional view of a conventional waterproof container.

Before the disclosure is described in greater detail, it should be noted that like elements are denoted by the same reference numerals throughout the disclosure.

Figure 2:
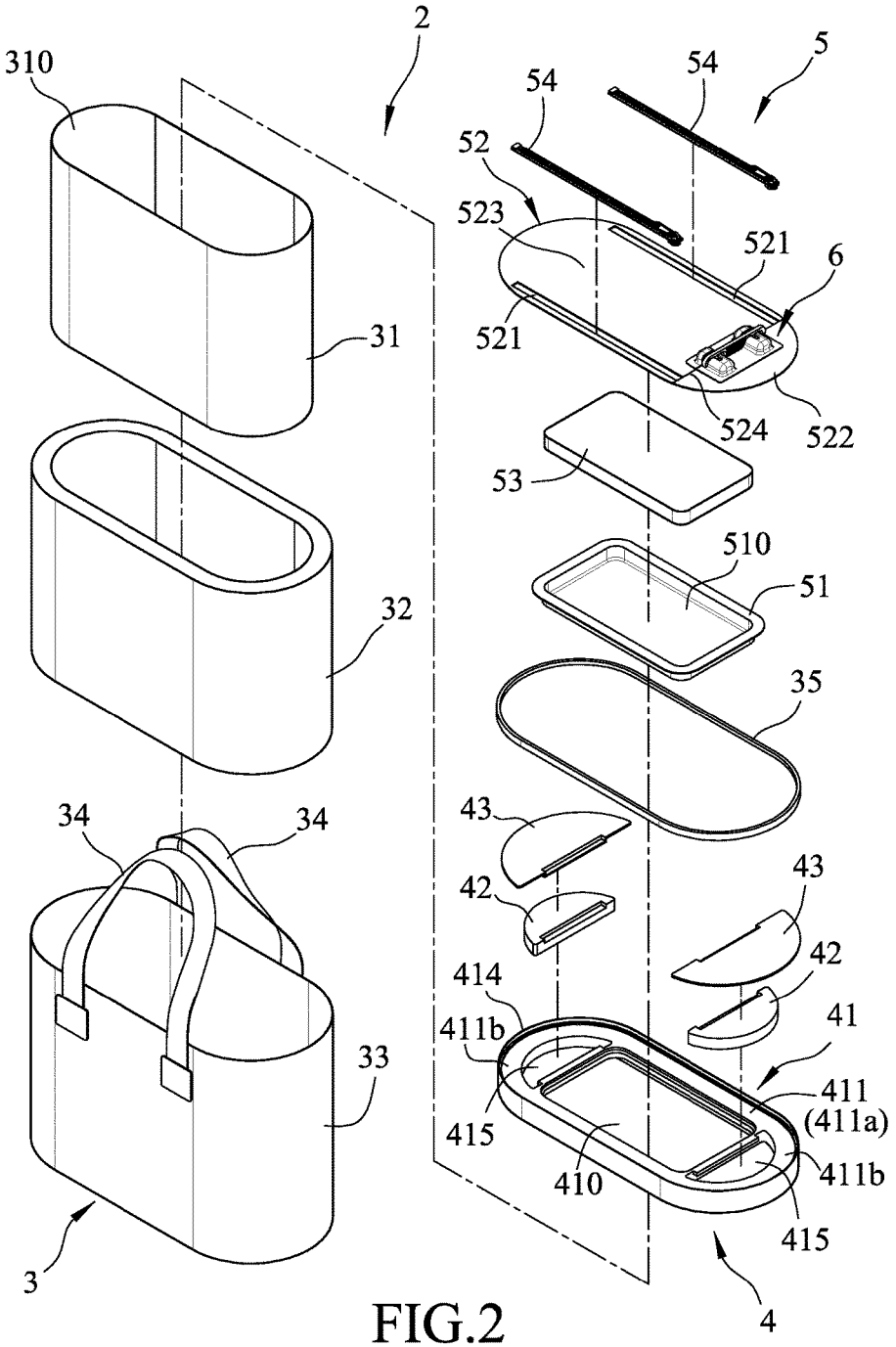
FIG. 2 is an exploded perspective view of a first embodiment of a waterproof container according to the disclosure.
Figure 3:
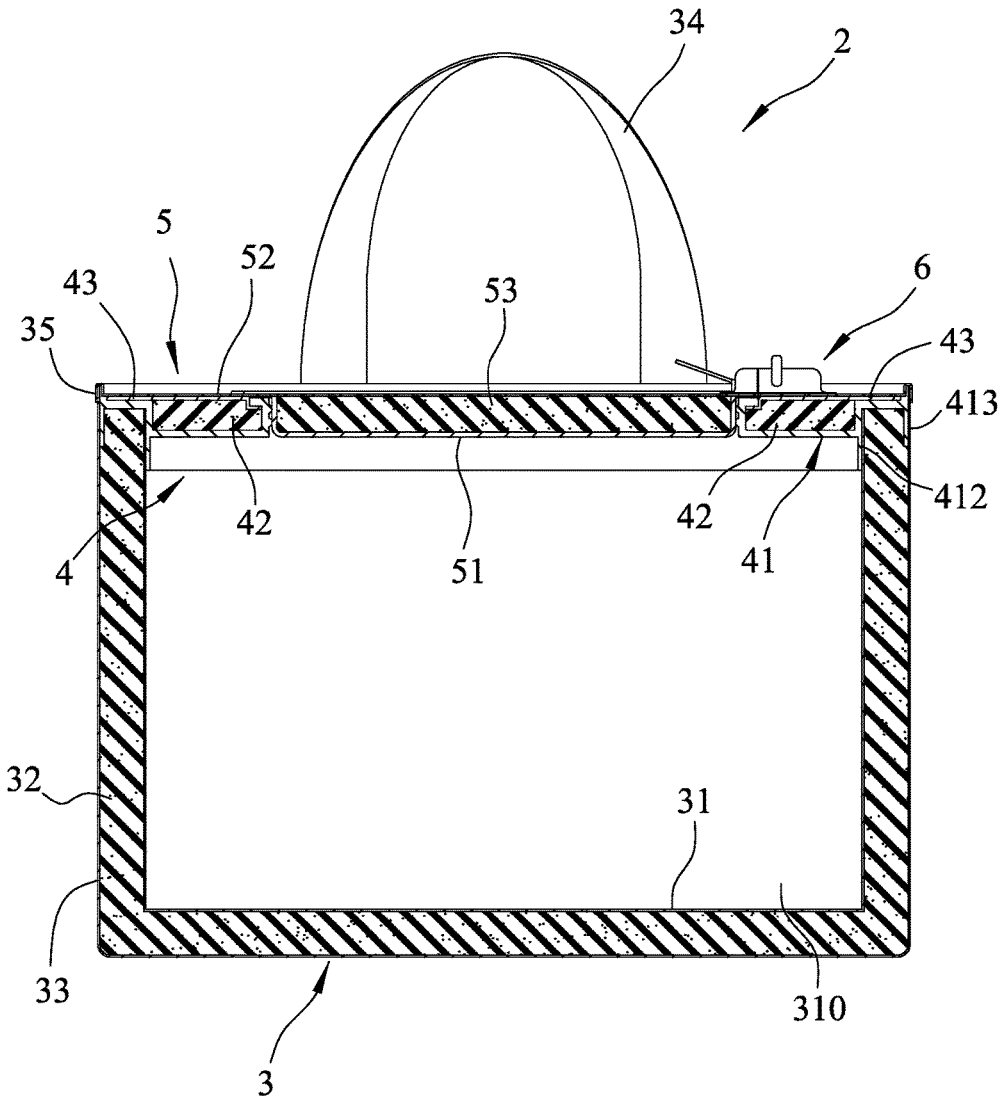
FIG. 3 is a sectional view of the first embodiment.
Figure 4:
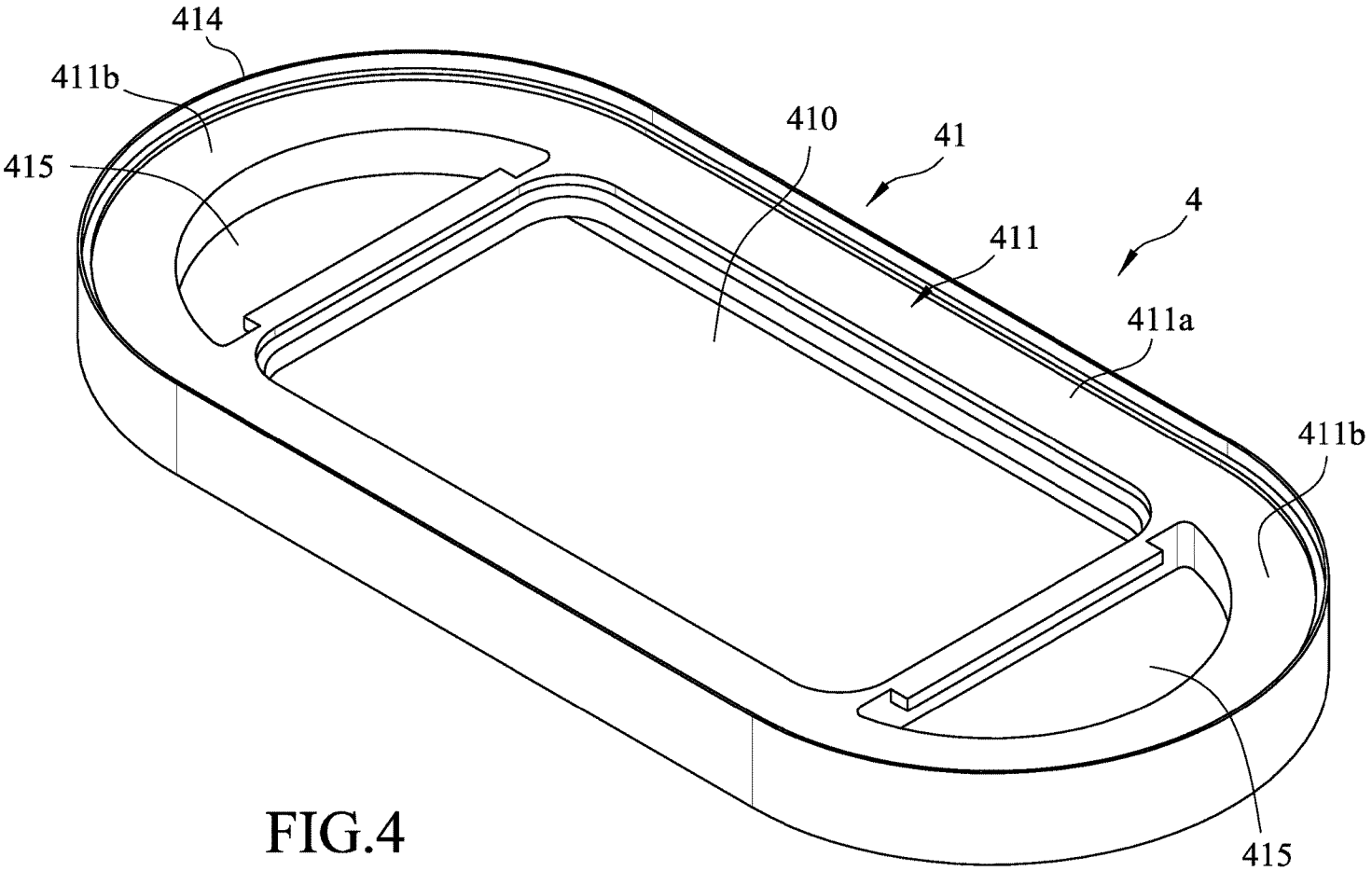
FIG. 4 is a top perspective view of the first embodiment, showing a receiving seat.
Figure 5:
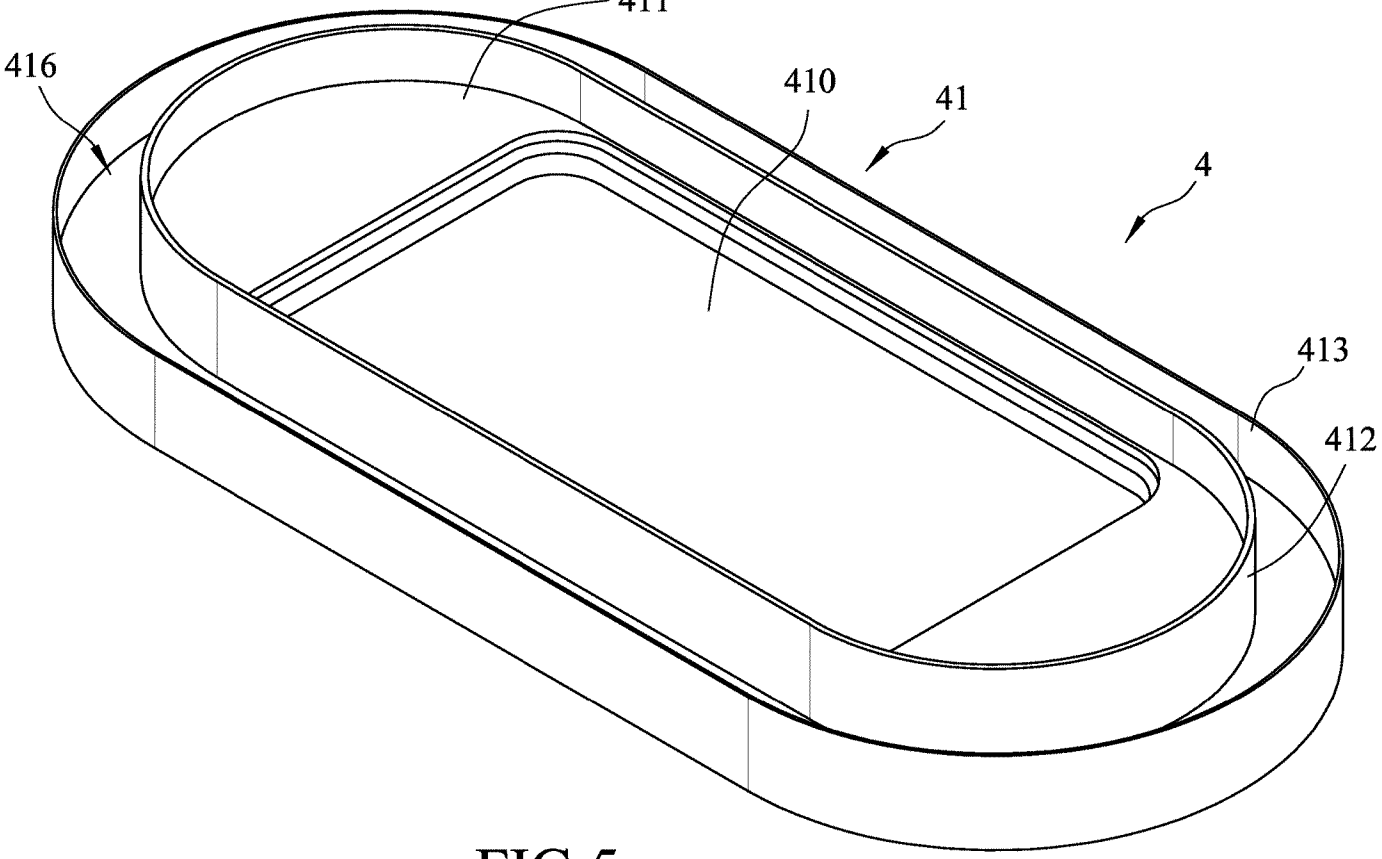
FIG. 5 is a bottom perspective view of the receiving seat shown in FIG. 4.

Referring to FIGS. 2 and 3, a first embodiment of a waterproof container 2 according to the disclosure includes a bag unit 3, a seat unit 4, a positioning frame 35, a cover unit 5 and a lock unit 6.

The bag unit 3 includes an inner bag 31, a waterproof layer 32, an outer bag 33 and two handling straps 34. The inner bag 31 defines an accommodating space 310. The waterproof layer 32 surrounds the inner bag 31 and is made of a foam material. The outer bag 33 surrounds the waterproof layer 32 and is made of fabric. The handling straps 34 are fixedly connected to the outer bag 33, e.g., by sewing.

The seat unit 4 includes a receiving seat 41, two waterproof pads 42 that are made of a foam material, and two retaining plates 43.

Referring to FIGS. 2, 4, 5 and 6, the receiving seat 41 is disposed on a top end of the bag unit 3. To be specific, the receiving seat 41 is disposed on top ends of the inner bag 31 and the waterproof layer 32. The receiving seat 41 includes a seat body 411, a lower extension wall 413, a positioning wall 412 and an upper extension wall 414. The lower extension wall 413 extends downwardly from an outer periphery of the seat body 411. The positioning wall 412 extends downwardly from the seat body 411, is spaced apart from the lower extension wall 413, and cooperates with the lower extension wall 413 and the seat body 411 to define an engaging groove 416 that engages the top ends of the inner bag 31 and the waterproof layer 32. The upper extension wall 414 extends upwardly from the outer periphery of the seat body 411. The seat body 411 has a main portion 411*a* and two side portions 411*b*. The main portion 411*a* defines an opening 410 in spatial communication with the accommodating space 310. The side portions 411*b* are located respectively at two opposite sides of the main portion 411*a*. The waterproof pads 42 are respectively disposed on the side portions 411*b*. To be specific, each of the side portions 411*b* of the seat body 411 is formed with a pad-receiving groove 415 that receives a respective one of the waterproof pads 42 therein.

Each of the retaining plates 43 covers a respective one of the waterproof pads 42, and retains the respective one of the waterproof pads 42 within the respective one of the pad-receiving grooves 415.

Figure 6:
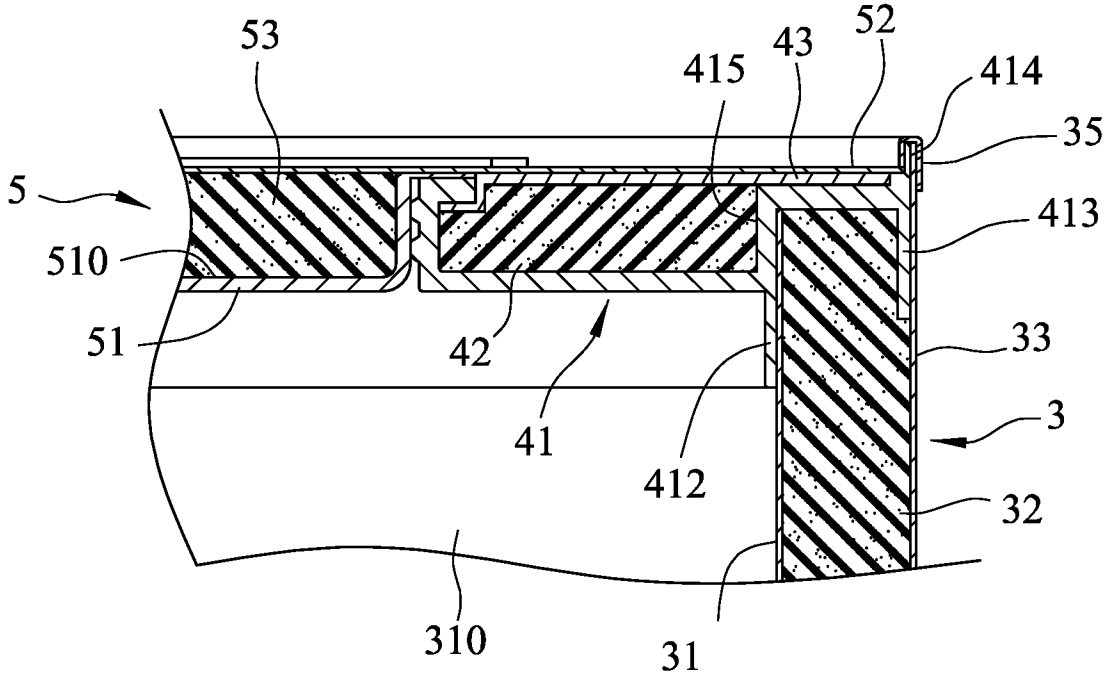
FIG. 6 is a fragmentary enlarged sectional view of FIG. 3, illustrating an assembly of the receiving seat, a bag unit and a cover unit of the first embodiment.

As best shown in FIG. 6, the inner bag 31 of the bag unit 3 is fixedly connected to the positioning wall 412 by heat sealing. The outer bag 33 of the bag unit 3 is attached onto outer surfaces of the lower and upper extension walls 413, 414, and has a top end that is flush with a top end of the upper extension wall 414. The positioning frame 35 is securely coupled to the top ends of the outer bag 33 and the upper extension wall 414. It should be noted that, the heights of the lower extension wall 413, the positioning wall 412 and the upper extension wall 414 may be identical or different. In certain embodiments, the lower extension wall 413 and the positioning wall 412 may extend downwardly from the seat body 411 by one inch, and the upper extension wall 414 may extend upwardly from the seat body 411 by one inch.

Figure 7:
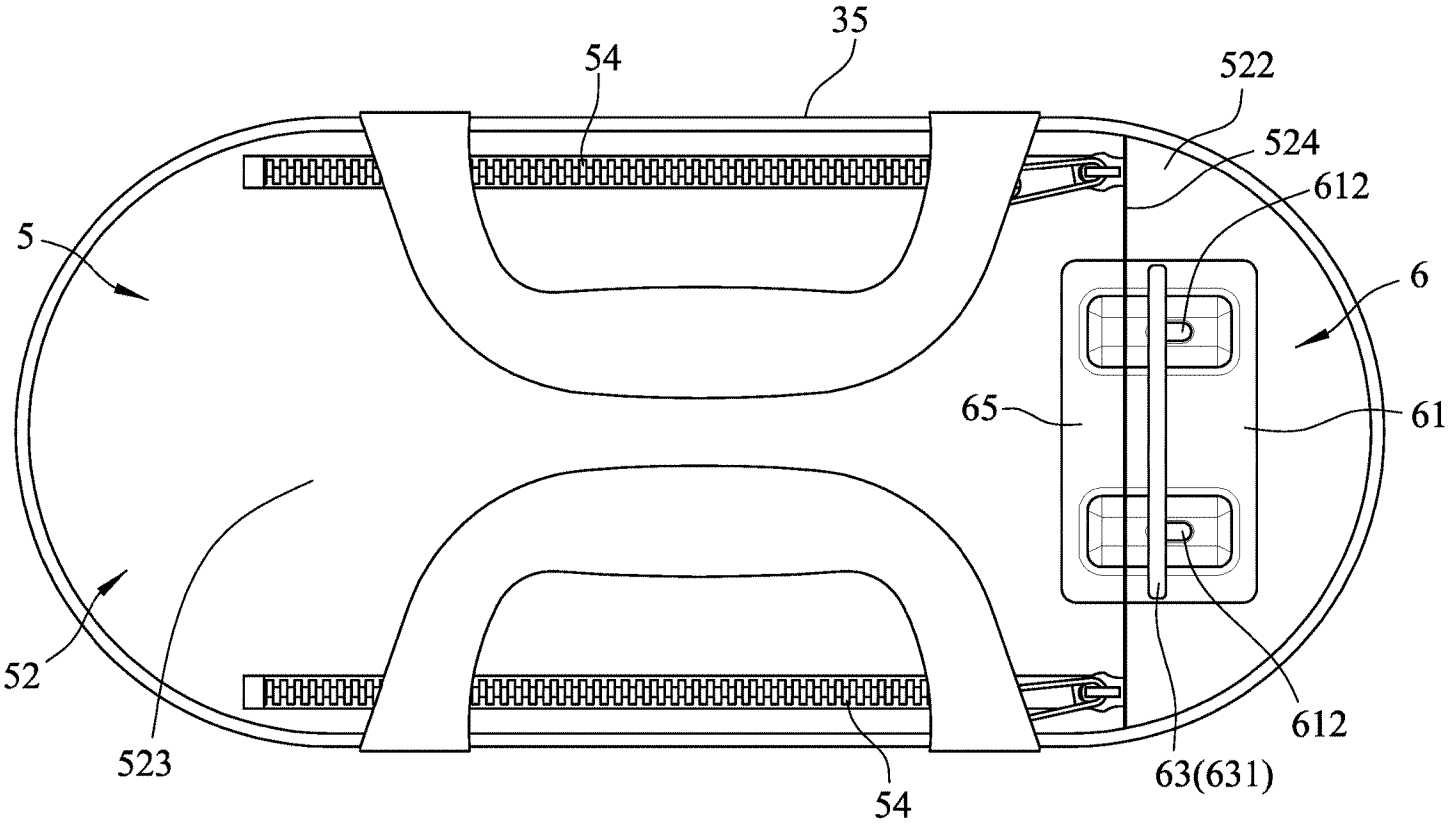
FIG. 7 is a top view of the first embodiment.

Referring to FIGS. 2, 3 and 7, the cover unit 5 includes a cover 52, two spaced-apart zippers 54, a tray 51 and a waterproof block 53.

The cover 52 is attached to a top surface of the receiving seat 41, removably and sealingly covers the opening 410 of the seat unit 4, and cooperates with the receiving seat 41 to confine the waterproof pads 42 and the retaining plates 43 therebetween. The cover 52 has two zipper-receiving portions 521. In this embodiment, the two zipper-receiving portions 521 are parallel.

The zippers 54 are respectively disposed on the zipper-receiving portions 521 of the cover 52, and divide the cover 52 into a flip portion 523 and a fixed portion 522. The flip portion 523 corresponds in position to the opening 410. The fixed portion 522 is fixed to a top surface of the seat body 411 of the receiving seat 41 and surrounds the flip portion 523.

As shown in FIG. 7, the cover 52 is formed with a gap 524 between the fixed portion 522 and the flip portion 523. The cover 52 is operable between a flipped state, where the zippers 54 are unzipped and the flip portion 523 is flipped open for exposing the opening 410 (see FIG. 10), and a non-flipped state, where the zippers 54 are zipped for covering the opening 410 with the flip portion 523.

Referring to FIGS. 2 and 3, the tray 51 removably covers the opening 410 and defines a receiving space 510.

The waterproof block 53 is made of a foam material, is fixedly received in the receiving space 510, and is fixed onto the flip portion 523 of the cover 52, so that the tray 51 covers and closes the opening 410 of the receiving seat 41 when the cover 52 is in the non-flipped state. In this embodiment, the tray 51 is press fitted into the opening 410 when the cover 52 is in the non-flipped state. For instance, the tray 51 and the opening 410 may differ in size by, but not limited to, 1 millimeter for enabling the tray 51 to be press fitted into the opening 410.

In this embodiment, the tray 51 is made of an elastic material such as rubber, and the receiving seat 41 is made of a rigid material so as to ensure a proper interference fit between the tray 51 and the opening 410 of the receiving seat 41. Alternatively, the tray 51 may be made of a rigid material, and the receiving seat 41 may be made of an elastic material, with no particular restrictions.

It should be noted that the cover 52 can be made of fabric or a rigid material. Each of the zipper-receiving portions 521 of the cover 52 is configured as a slot that extends through top and bottom surfaces of the cover 52.

Figure 8:
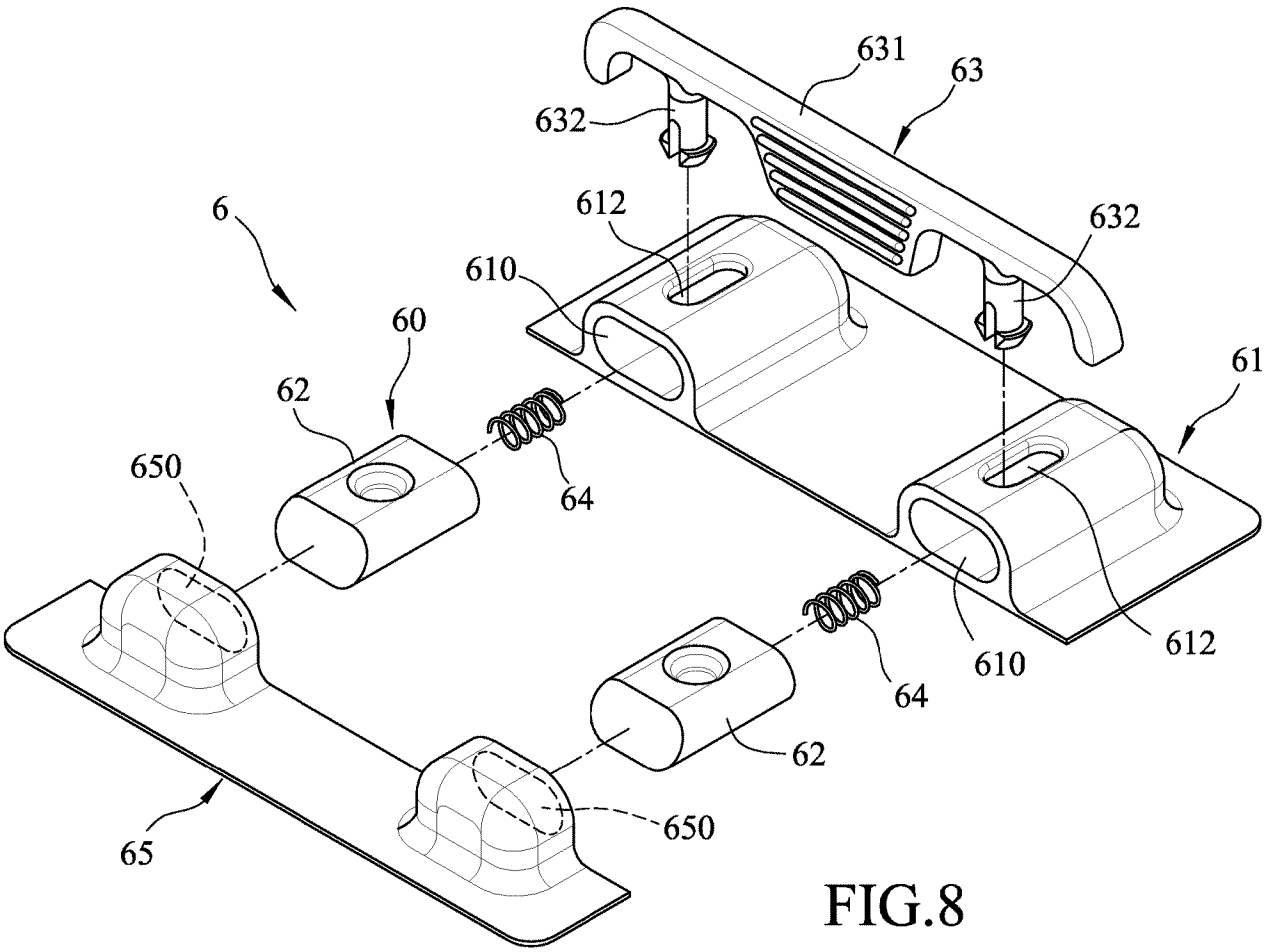
FIG. 8 is an exploded perspective view of the first embodiment, showing a lock unit.
Figure 9:
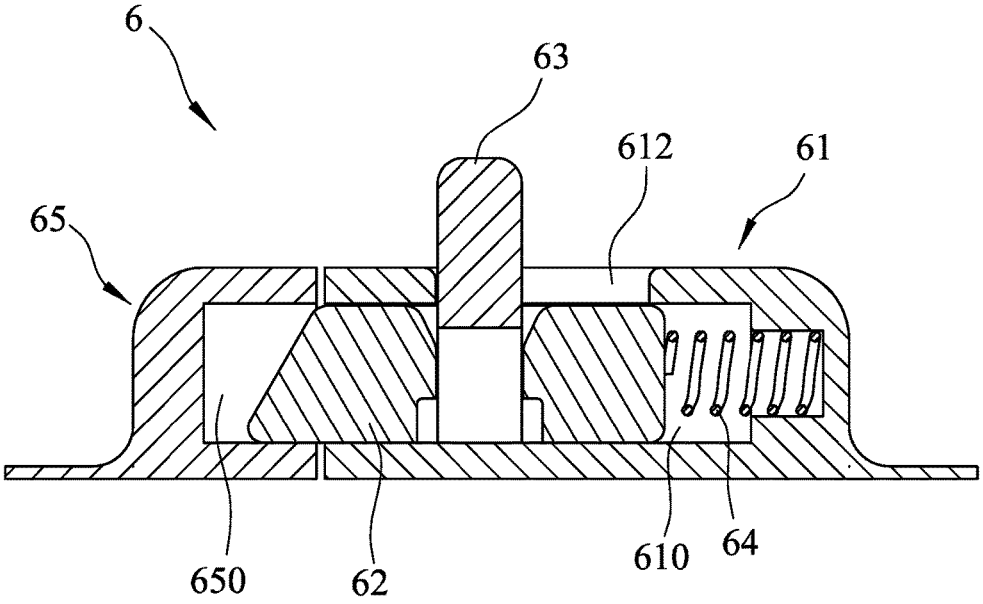
FIG. 9 is a sectional view of the first embodiment of the lock unit.

Referring to FIGS. 7, 8 and 9, the lock unit 6 is mounted to the cover unit 5, and includes a first lock seat 61, a second lock seat 65, a locking mechanism 60 and a slidable handle 63.

The first lock seat 61 is disposed on the fixed portion 522 of the cover 52. The first lock seat 61 is formed with two spaced-apart first receiving holes 610, and two spaced-apart slide slots 612 that spatially communicate with the first receiving holes 610, respectively.

The second lock seat 65 is disposed on the flip portion 523 of the cover 52, and is formed with two second receiving holes 650 that open toward the first receiving holes 610, respectively. The first and second lock seats 61, 65 are respectively and fixedly disposed at two opposite sides of the gap 524 and adjacent to the gap 524.

The locking mechanism 60 is operable between a locking state, where the locking mechanism 60 engages the first and second lock seats 61, 65 so as to prevent the flip portion 523 of the cover 52 from being flipped open when the zippers 54 are unzipped, and a releasing state, where the locking mechanism 60 does not engage the first and second lock seats 61, 65 so as to allow the flip portion 523 to be flipped open when the zippers 54 are unzipped.

The locking mechanism 60 includes two locking pins 62 and two resilient members 64. The locking pins 62 are slidably and respectively disposed in the first receiving holes 610 of the first lock seat 61. Each of the locking pins 62 engages a respective one of the first receiving holes 610 and a respective one of the second receiving holes 650 when the locking mechanism 60 is in the locking state, and is disengaged from the respective one of the second receiving holes 650 when the locking mechanism 60 is in the releasing state.

The resilient members 64 are respectively received in the first receiving holes 610. Each of the resilient members 64 generates a biasing force which biases a respective one of the locking pins 62 to move toward a respective one of the second receiving holes 650 so that the locking pins 62 engage the first and second receiving holes 610, 650 when the locking mechanism 60 is in the locking state.

The slidable handle 63 extends into the first receiving holes 610 through the slide slots 612, is coupled to the locking pins 62, and is operable to slide within the slide slots 612 so as to convert the locking mechanism 60 between the locking state and the releasing state. In greater detail, the slidable handle 63 has a hold portion 631 and two connecting portions 632. Each of the connecting portions 632 extends from the hold portion 631 and into a respective one of the first receiving holes 610 through a respective one of the slide slots 612, and is coupled to a respective one of the locking pins 62.

It should be noted that the number of the locking pins 62 and the numbers of the respective resilient members 64, of the first receiving holes 610, of the second receiving holes 650 and of the slide slots 612 are two in this embodiment. In other variations of the embodiment, the numbers of the locking pins 62 and of the respective components are not limited to two, and may be one, three, four, etc.

Figure 10:
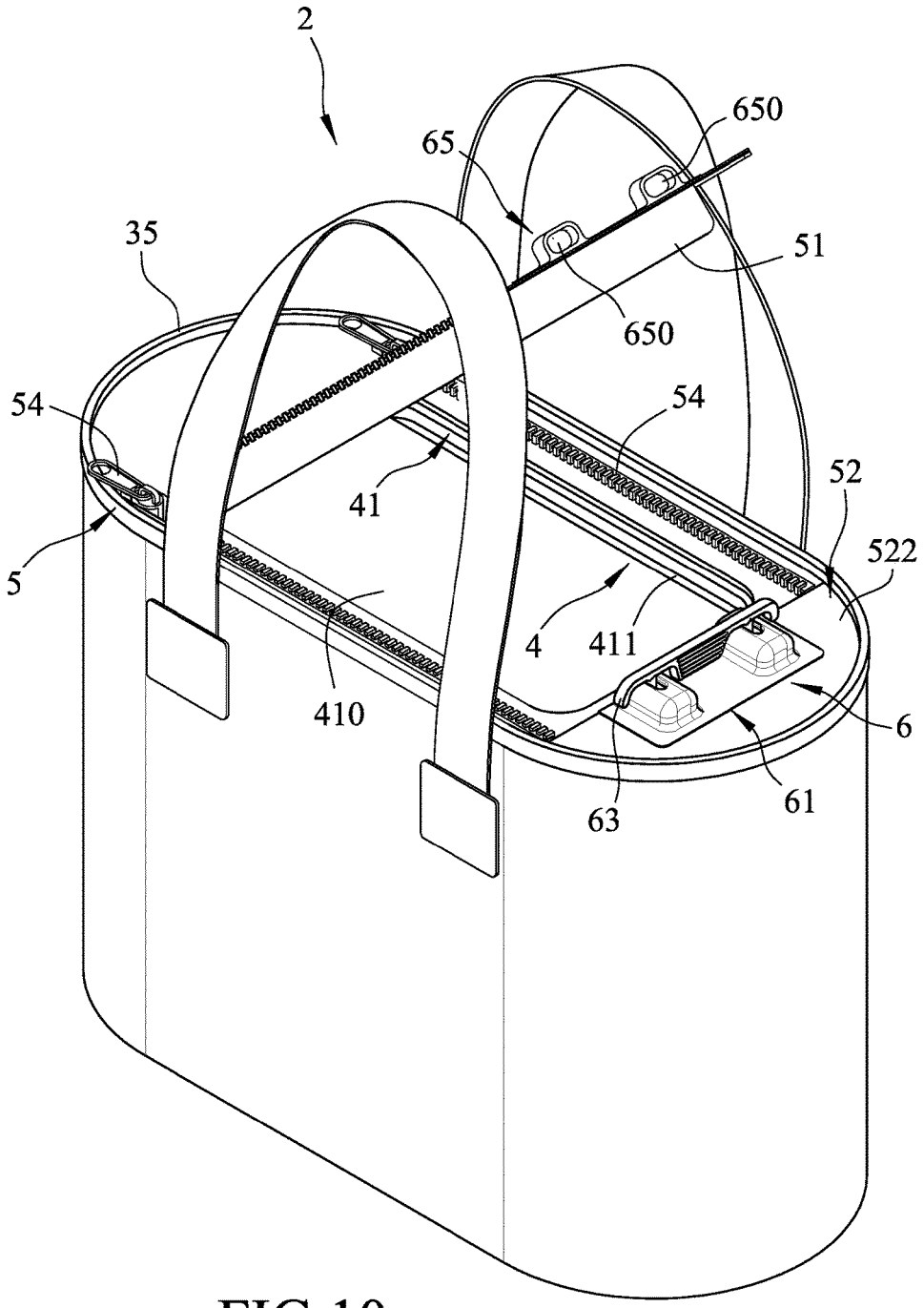
FIG. 10 is a perspective view of the first embodiment, illustrating a cover in a flipped state.

Referring to FIGS. 7, 8 and 10, when storing an article (not shown) in the waterproof container 2, the zippers 54 are first unzipped, and then the slidable handle 63 is pulled manually in a direction away from the second lock seat 65 so that the connecting portions 632 of the slidable handle 63 drives the locking pins 62 to be disengaged respectively from the second receiving holes 650. At this time, the locking mechanism 60 is in the releasing state, and the flip portion 523 of the cover 52 can be flipped open so as to remove the tray 51 from the opening 410 of the receiving seat 41 (see FIG. 10). After the article is placed into the accommodating space 310 (see FIG. 2) through the opening 410, the slidable handle 63 is pulled manually in a direction away from the second lock seat 65 and the tray 51 is press fitted back into the opening 410 for covering the opening 410. The slidable handle 63 is then released, so that the resilient members 64 is enabled to bias the locking pins 62 to move toward the second receiving holes 650, and that the locking pins 62 engage the first and second receiving holes 610, 650, thereby converting the locking mechanism 60 back to the locking state. The zippers 54 can be zipped before, during or after the locking mechanism 60 is converted back to the locking state.

It should be noted that the cover 52 can be made of fabric or a rigid material. Each of the zipper-receiving portions 521 of the cover 52 is configured as a slot that extends through top and bottom surfaces of the cover 52. In other variations of the embodiment, provided that the cover 52 is made of a rigid material, the zippers 54 may be omitted so that the number of components of the waterproof container 2 is reduced, and the process for placement or removal of the article into or out of the waterproof container 2 is simpler.

Figure 11:
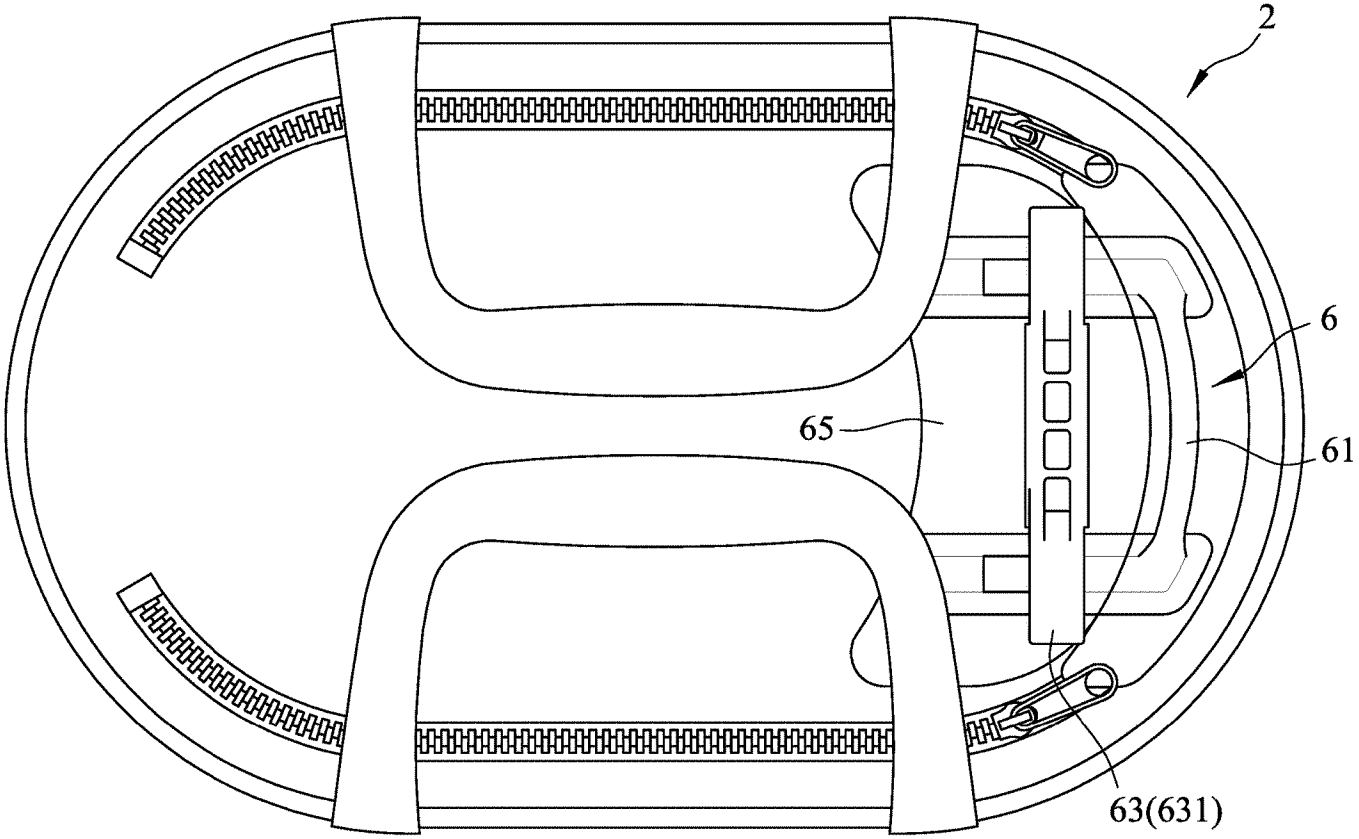
FIG. 11 is a top view of a second embodiment of the waterproof container according to the disclosure.
Figure 12:
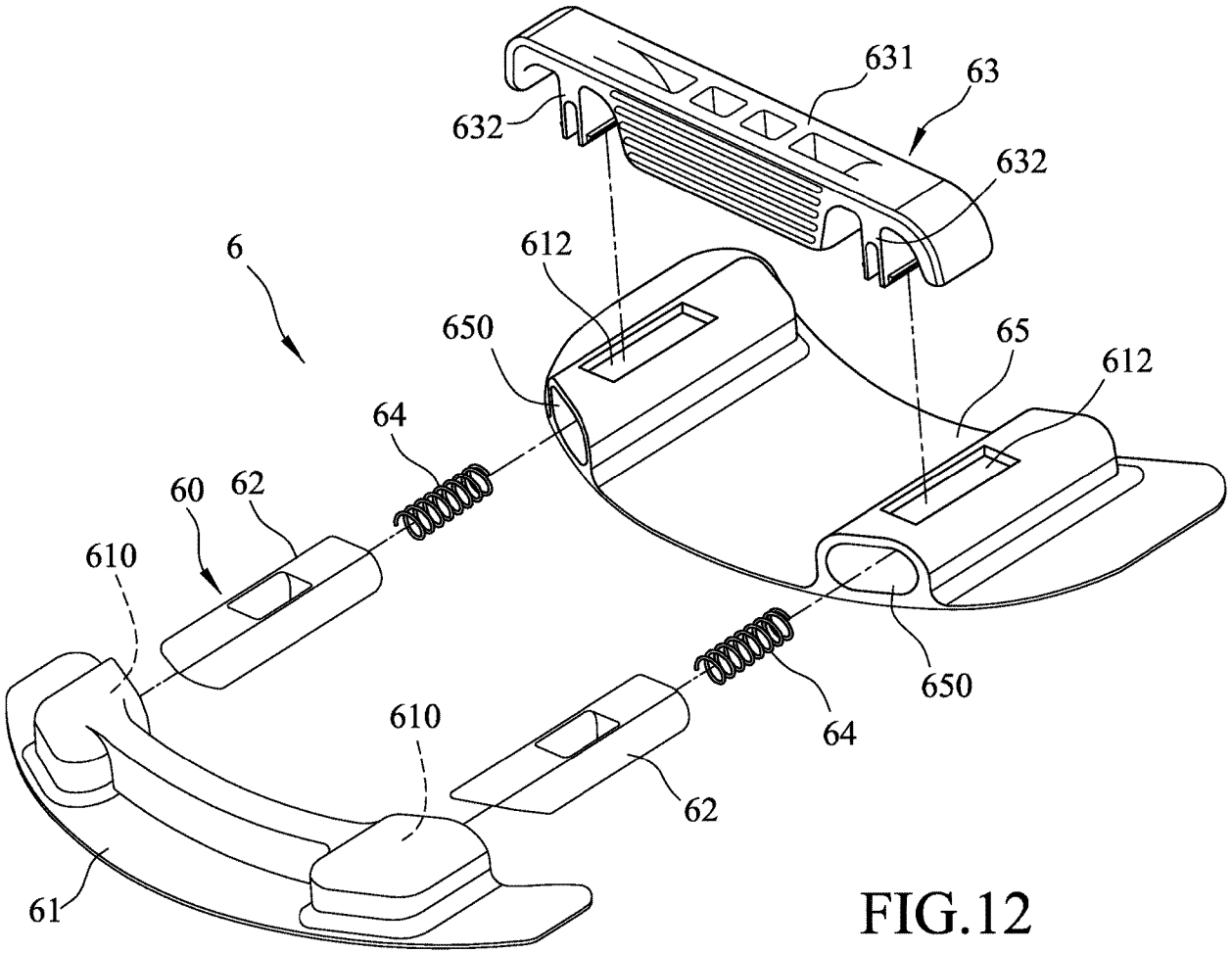
FIG. 12 is an exploded perspective view of the second embodiment, showing the lock unit.

Referring to FIGS. 11 and 12, a second embodiment of the waterproof container 2 according to the disclosure is similar to the first embodiment. The difference between the first and second embodiments resides in that the slide slots 612 of the second embodiment are formed in the second lock seat 65. Accordingly, the locking pins 62 and the resilient members 64 of the second embodiment are disposed in the second receiving holes 650.

To sum up, the waterproof layer 32, the waterproof pads 42 and the waterproof block 53 provide thermal insulation and waterproof properties. The configuration of the receiving seat 41 and interference fit between the tray 51 and the opening 410 provide a watertight seal for the waterproof container 2. Comparing to the above-mentioned conventional waterproof container 1, since the zippers 54 of the waterproof container 2 in this disclosure are straight and are disposed on a top surface of the cover 52, the zippers 54 are less likely to break off, and can be zipped or unzipped smoothly. Furthermore, the lock unit 6 has a relatively high structural strength comparing to the zipper 15 of the conventional waterproof container 1, thereby ensuring proper covering and protection of the waterproof container 2.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A waterproof container comprising:

a bag unit defining an accommodating space;

a seat unit disposed on a top end of said bag unit and defining an opening that is in spatial communication with said accommodating space;

a cover unit including a cover that removably and sealingly covers said opening of said seat unit, and two spaced-apart zippers that are disposed on said cover and that divide said cover into a fixed portion connected fixedly to said seat unit, and a flip portion corresponding in position to said opening, said cover being operable between a flipped state, where said zippers are unzipped and said flip portion is flipped open for exposing said opening, and a non-flipped state, where said zippers are zipped for covering said opening with said flip portion; and a lock unit mounted to said cover unit, and including a first lock seat that is disposed on one of said fixed portion and said flip portion, a second lock seat that is disposed on the other one of said fixed portion and said flip portion, and a locking mechanism that is operable between a locking state, where said locking mechanism engages said first and second lock seats so as to prevent said flip portion of said cover from being flipped open when said zippers are unzipped, and a releasing state, where said locking mechanism does not engage said first and second lock seats so as to allow said flip portion to be flipped open when said zippers are unzipped;

wherein said locking mechanism includes a locking pin slidably disposed at said first lock seat, said locking pin engaging said first and second lock seats when said locking mechanism is in the locking state, said locking pin being disengaged from said second lock seat when said locking mechanism is in the releasing state;

wherein said first lock seat of said lock unit is formed with a first receiving hole;

wherein said second lock seat is formed with a second receiving hole that opens toward said respective at least one first receiving hole; and wherein said locking pin is slidably disposed in said first receiving hole, said locking pin engaging said first and second receiving holes when said locking mechanism is in the locking state, and being disengaged from said second receiving hole when said locking mechanism is in the releasing state.

2. The waterproof container as claimed in claim 1, wherein said cover is formed with a gap between said fixed portion and said flip portion, said first and second lock seats being disposed at two opposite sides of said gap and adjacent to said gap.

3. The waterproof container as claimed in claim 1, wherein said cover has two spaced-apart zipper-receiving portions that permit said zippers respectively mounted thereonto.

4. The waterproof container as claimed in claim 1, wherein said locking mechanism further includes a resilient member that is received in said first receiving hole, and that generates a biasing force which biases said locking pin to move toward said second receiving hole so that said locking pin engages said first and second receiving holes when said locking mechanism is in the locking state.

5. The waterproof container as claimed in claim 4, wherein said first lock seat of said lock unit is formed with a slide slot in spatial communication with said first receiving hole, said lock unit further including a slidable handle that extends into said first receiving hole through said slide slot, that is coupled to said locking pin, and that is operable to slide within said slide slot so as to convert said locking mechanism between the locking state and the releasing state.

6. The waterproof container as claimed in claim 5, wherein said slidable handle has a hold portion, and a connecting portion that extends from said hold portion and into said first receiving hole through said slide slot, and that is coupled to said locking pin.

7. A waterproof container comprising:

a bag unit defining an accommodating space;

a seat unit disposed on a top end of said bag unit and defining an opening that is in spatial communication with said accommodating space;

a cover unit including a cover that removably and sealingly covers said opening of said seat unit, and two spaced-apart zippers that are disposed on said cover and that divide said cover into a fixed portion connected fixedly to said seat unit, and a flip portion corresponding in position to said opening, said cover being operable between a flipped state, where said zippers are unzipped and said flip portion is flipped open for exposing said opening, and a non-flipped state, where said zippers are zipped for covering said opening with said flip portion; and a lock unit mounted to said cover unit, and including a first lock seat that is disposed on one of said fixed portion and said flip portion, a second lock seat that is disposed on the other one of said fixed portion and said flip portion, and a locking mechanism that is operable between a locking state, where said locking mechanism engages said first and second lock seats so as to prevent said flip portion of said cover from being flipped open when said zippers are unzipped, and a releasing state, where said locking mechanism does not engage said first and second lock seats so as to allow said flip portion to be flipped open when said zippers are unzipped;

wherein said locking mechanism includes a plurality of locking pins slidably mounted to said first lock seat, said locking pins engaging said first and second lock seats when said locking mechanism is in the locking state, said locking pins being disengaged from said second lock seat when said locking mechanism is in the releasing state;

wherein said first lock seat of said lock unit is formed with a plurality of first receiving holes;

wherein said second lock seat is formed with a plurality of second receiving holes opening toward said first receiving holes, respectively; and wherein said locking pins are slidably and respectively disposed in said first receiving holes, each of said locking pins engaging a respective one of said first receiving holes and a respective one of said second receiving holes when said locking mechanism is in the locking state, and being disengaged from the respective one of said second receiving holes when said locking mechanism is in the releasing state.

8. The waterproof container as claimed in claim 7, wherein said cover is formed with a gap between said fixed portion and said flip portion, said first and second lock seats being disposed at two opposite sides of said gap and adjacent to said gap.

9. The waterproof container as claimed in claim 7, wherein said locking mechanism further includes a plurality of resilient members that are respectively received in said first receiving holes, each of said resilient members generating a biasing force which biases a respective one of said locking pins to move toward a respective one of said second receiving holes so that said locking pins engage said first and second receiving holes.

10. The waterproof container as claimed in claim 9, wherein said first lock seat of said lock unit is formed with a plurality of spaced-apart slide slots spatially and respectively communicating with said first receiving holes, said lock unit further including a slidable handle that extends into said first receiving holes through said slide slots, that is coupled to said locking pins, and that is operable to slide within said slide slots so as to convert said locking mechanism between the locking state and the releasing state.

11. The waterproof container as claimed in claim 10, wherein said slidable handle has a hold portion, and a plurality of connecting portions each extending from said hold portion and into a respective one of said first receiving holes through a respective one of said slide slots, and being coupled to a respective one of said locking pins.

12. The waterproof container as claimed in claim 7, wherein said cover has two spaced-apart zipper-receiving portions that permit said zippers respectively mounted thereonto.

13. A waterproof container comprising:

a bag unit defining an accommodating space;

a seat unit disposed on a top end of said bag unit and defining an opening that is in spatial communication with said accommodating space;

a cover unit including a cover that removably and sealingly covers said opening of said seat unit, and two spaced-apart zippers that are disposed on said cover and that divide said cover into a fixed portion connected fixedly to said seat unit, and a flip portion corresponding in position to said opening, said cover being operable between a flipped state, where said zippers are unzipped and said flip portion is flipped open for exposing said opening, and a non-flipped state, where said zippers are zipped for covering said opening with said flip portion; and a lock unit mounted to said cover unit, and including a first lock seat that is disposed on one of said fixed portion and said flip portion, a second lock seat that is disposed on the other one of said fixed portion and said flip portion, and a locking mechanism that is operable between a locking state, where said locking mechanism engages said first and second lock seats so as to prevent said flip portion of said cover from being flipped open when said zippers are unzipped, and a releasing state, where said locking mechanism does not engage said first and second lock seats so as to allow said flip portion to be flipped open when said zippers are unzipped;

wherein said bag unit includes an inner bag defining said accommodating space, a waterproof layer surrounding said inner bag, an outer bag surrounding said waterproof layer, and two handling straps fixedly connected to said outer bag;

wherein said seat unit includes a receiving seat that is disposed on top ends of said inner bag and said waterproof layer, and that includes a seat body, said seat body having a main portion that defines said opening, and two side portions that are located respectively at two opposite sides of said main portion, two waterproof pads respectively disposed on said side portions, and two retaining plates each covering a respective one of said waterproof pads;

wherein said cover of said cover unit is attached to a top surface of said receiving seat, and cooperates with said receiving seat to confine said waterproof pads and said retaining plates therebetween; and wherein said receiving seat further includes a lower extension wall extending downwardly from an outer periphery of said seat body, and a positioning wall extending downwardly from said seat body, being spaced apart from said lower extension wall, and cooperating with said lower extension wall and said seat body to define an engaging groove that engages the top ends of said inner bag and said waterproof layer.

14. The waterproof container as claimed in claim 13, wherein said receiving seat further includes an upper extension wall extending upwardly from said outer periphery of said seat body, said outer bag of said bag unit being attached onto outer surfaces of said lower and upper extension walls.

15. The waterproof container as claimed in claim 14, further comprising a positioning frame that is securely coupled to top ends of said outer bag and said upper extension wall.

16. The waterproof container as claimed in claim 15, wherein said cover unit further includes a tray that removably covers said opening and that defines a receiving space, and a waterproof block that is fixedly received in said receiving space and that is fixed onto said flip portion of said cover, so that said tray covers and closes said opening of said receiving seat when said cover is in the non-flipped state.

17. The waterproof container as claimed in claim 16, wherein said tray is press fitted into said opening when said cover is in the non-flipped state.

18. The waterproof container as claimed in claim 13, wherein said cover is formed with a gap between said fixed portion and said flip portion, said first and second lock seats being disposed at two opposite sides of said gap and adjacent to said gap.

19. The waterproof container as claimed in claim 13, wherein said cover has two spaced-apart zipper-receiving portions that permit said zippers respectively mounted thereonto.

* * * * *